United States Patent [19]

Lambert et al.

[11] 4,108,068

[45] Aug. 22, 1978

[54] INK AGITATOR

[75] Inventors: Gerard Edouard Lambert, Saint-Cloud; Roger Begis, Chaville, both of France

[73] Assignee: Seveg, S.A., Sevres, France

[21] Appl. No.: 791,688

[22] Filed: Apr. 28, 1977

Related U.S. Application Data

[63] Continuation of Ser. No. 686,455, May 14, 1976, abandoned, which is a continuation-in-part of Ser. No. 549,324, Feb. 12, 1975, abandoned.

[30] Foreign Application Priority Data

Feb. 12, 1974 [FR] France ..... 74 04603

[51] Int. Cl.[2] ..... B41F 31/02

[52] U.S. Cl. ..... 101/363; 101/364

[58] Field of Search ..... 101/207, 208, 210, 269, 101/350, 363, 364; 259/47, 70, 71, 102, 112, 113

[56] References Cited

U.S. PATENT DOCUMENTS

| | | | |
|---|---|---|---|
| 1,778,600 | 10/1930 | Jones | 101/364 |
| 2,043,056 | 6/1936 | Mueller | 101/269 |
| 2,120,978 | 6/1938 | Huck | 101/350 |
| 2,234,754 | 3/1941 | Gegenheimer | 101/364 |
| 2,617,191 | 11/1952 | Detjen | 259/102 |
| 3,000,300 | 9/1961 | Ortleb | 101/364 |
| 3,018,725 | 1/1962 | Maul et al. | 101/269 |
| 3,084,625 | 4/1963 | Gegenheimer | 101/364 |
| 3,856,273 | 12/1974 | Born | 259/112 X |

FOREIGN PATENT DOCUMENTS

| | | | |
|---|---|---|---|
| 1,110,028 | 4/1968 | United Kingdom | 101/364 |

*Primary Examiner*—J. Reed Fisher

*Attorney, Agent, or Firm*—Leydig, Voit, Osann, Mayer & Holt, Ltd.

[57] ABSTRACT

A self driven mobile assembly including an ink agitator is supported on the ink fountain of a printing machine by a beam which is adapted to be mounted parallel to the longitudinal axis of the ink fountain so as to provide a guide track for supporting the mobile assembly for linear displacement along the ink fountain with the ink agitator projecting into the ink. The beam has a rack extending parallel to said ink fountain axis, and the mobile assembly includes a reversible motor and drive means connecting the motor both to rotate the agitator and to linearly displace the assembly along the beam by driving a pinion meshing with the rack. The beam also has an exposed bus electrically insulated from the beam and lying parallel to the rack, and the mobile assembly has a pair of members, one mounted for sliding electrical contact along the bus and the other mounted for sliding electrical contact along a portion of the beam separate from the bus for supplying electrical power to the assembly. Adjustable stops are mounted on the beam and the assembly includes motor control circuit means including micro switches mounted for movement alternately into engagement with the stops to control the operation of the motor in automatically reciprocating the assembly along the beam between the stop defined limits.

4 Claims, 6 Drawing Figures

INK AGITATOR

This is a continuation, of application Ser. No. 686,455, for "Ink Agitator", filed May 14, 1976, now abandoned, which is a continuation-in-part of Ser. No. 549,324, filed Feb. 12, 1975, now abandoned, entitled "Ink Stirrer for Printing Machines"

The invention relates to an agitator for homogenizing the ink mass in the ink fountain of a printing machine.

Printing machines, and particularly offset presses, are generally provided with an ink fountain in the form of a rotating roller and a blade spaced from the roller by an adjustable distance corresponding to the thickness of the ink film which flows through the resulting gap.

In operation, a predetermined quantity of ink is maintained in the ink fountain, either manually or by means of an automatic supply. Since the ink in the ink fountain is exposed to the air, it has been observed that oxidation causes a surface skin to form, unless the ink is continuously stirred or mixed. The presence of such a surface skin on the ink presents a serious problem, because it becomes mixed in with the rest of the mass. When the ink is subsequently picked up by the inking and printing rollers, this hurts the printing quality and the uniformity of supply of the ink film provided by the gap between the rotating roller and the blade. Moreover, the ingredients of these inks undergo changes when not kept in movement, and so do the physiochemical properties of contact between the metal forming the ink well and the ink itself (surface tension). This, in turn, changes the quantity of ink which passes through the space between the blade and the rotating roller.

To overcome these problems, it has been proposed to equip the ink fountain of printing machines with a mechanical stirrer, in the form of a cone driven in rotation and displaced linearly in reciprocating translation. This stirrer is generally mounted on a shaft, and displaced linearly parallel to the blade and the axis of the rotating ink roller. The shaft is coupled to driving means, generally consisting of a motor attached to the frame of the machine and coupled to the stirring device by transmission means such as belts, chains, or the like. While such arrangements were undeniably preferable to manual stirring, they nevertheless had the disadvantages of being heavy and cumbersome, and ill-suited to modern machines due to their lack of flexibility. In addition, the many elements of which this type of arrangement was composed appreciably raised its cost.

It is, accordingly, an object of the invention to overcome the foregoing disadvantages by providing a power driven stirrer or agitator in the form of a self driven assembly for mounting on the ink fountain. This makes it possible to eliminate the conventional transmission from a separate source of power which normally results in a massive, complex assembly.

A related object is to provide a self driven mobile assembly having means for rotating and linearly displacing the agitator, which assembly is movable along a guide track equipped with means for supplying electric power to the mobile assembly.

More specifically, it is an object of the invention to provide a track adapted to be mounted on an ink fountain which provides for guidance and retention of the mobile assembly.

For further details, reference is made to the following description, in the light of the accompanying drawings, wherein.

Referring now to these drawings, the preferred embodiment shown therein comprises an agitator 1, a track 2 which provides both guidance and electrical supply connections, a housing 3 which carries the agitator 1 and which together provide a mobile self driven assembly movable along the track 2 and, spaced elements 4 which define the limits of the linear travel of the assembly and cooperate with elements in the housing 3 to reverse the direction of travel of the assembly automatically at each of the limits so that the agitator 1 is driven in rotation and reciprocating translation.

Figure 3:
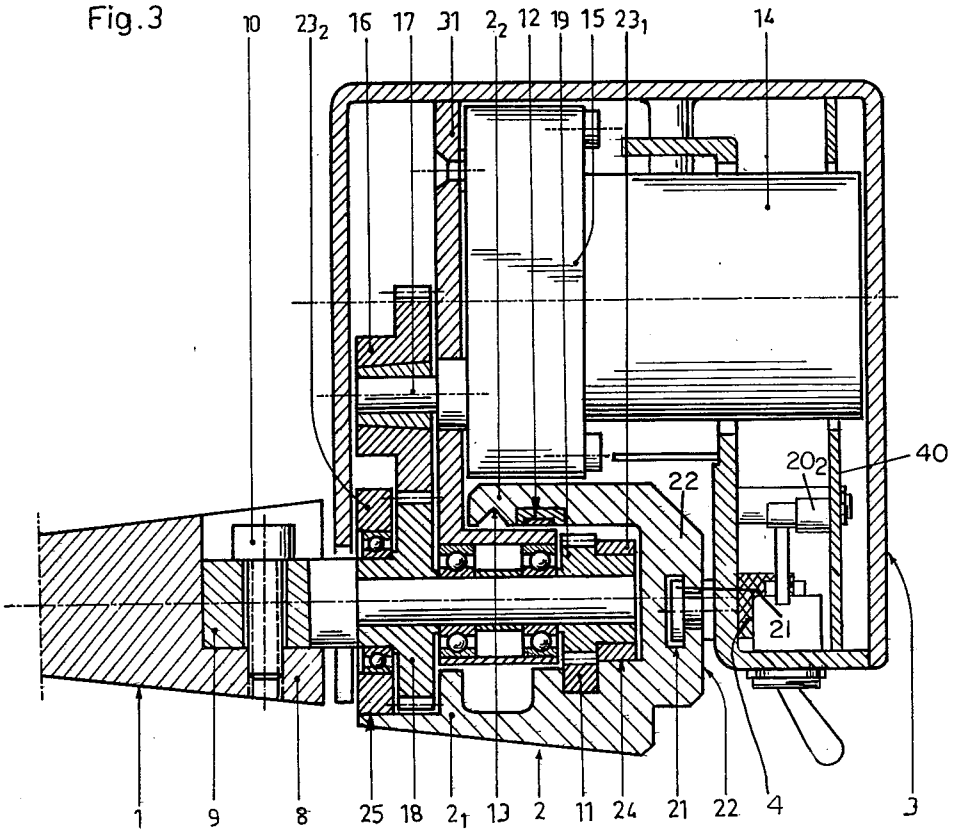
FIG. 3 is a view in section taken in the plane of lines 3—3 of FIG. 2.

The agitator itself takes the form of a conical member (FIG. 1), whose conical surface is parallel to and close to the bottom of the ink fountain defined by the tangential blade 6 and inking roller 7. The agitator 1 (see FIG. 3) has a portion 8 receiving the extremity of a mounting shaft 9 extending from the housing 3 to which it is attached by a bolt 10. Thus, the agitator 1 forms a unitary rotating member with the shaft 9, but can easily be replaced simply by withdrawal of bolt 10. This arrangement facilitates the cleaning of the equipment, since only the agitator needs to be replaced.

The guide track or beam 2 may be of unitary construction, if desired. It has a generally U-shaped cross-section, with the open side facing the agitator 1. The mounting shaft 9 for the agitator 1 extends into the hollow of this beam, and is retained and guided thereby. The guide track or beam may be formed by casting or extrusion, and has a gear rack 11 mounted on the inside of its arm $2^1$. On the inside of its arm $2^2$, it has an elongated energized electric bus 12 which is insulated from the track 2 but presents a flat exposed surface electrically contacted by a sliding contact member C for supply of electrical power to the movable housing 3. That arm also bears a straight groove 13, whose purpose is described further below.

The housing 3 and the agitator 1 provide a mobile assembly movable along the track 2, the housing having mounted therein the drive means for producing rotation of the agitator 1 and linear displacement of the mobile assembly. These drive means consist of a reversible motor 14 and its reduction gear 15, and motor or driving gear 16 attached to the output shaft 17 of the reduction gear and having its teeth meshing with those of a driven gear 18 attached to shaft 9 of the agitator 1. When electrical power is supplied to the motor, the latter produces rotation of the agitator 1. The same motor 14 also produces linear displacement of the housing 3 by means including a pinion gear 19 on the shaft 9 whose teeth mesh with the fixed gear rack 11 on the guide track 2. Since the gear 19 is also mounted on the agitator shaft 9, rotation of the shaft 9 by the motor 14 produces rotation of the gear 19 which thereupon is displaced along the rack.

Figures 2, 5, 6:
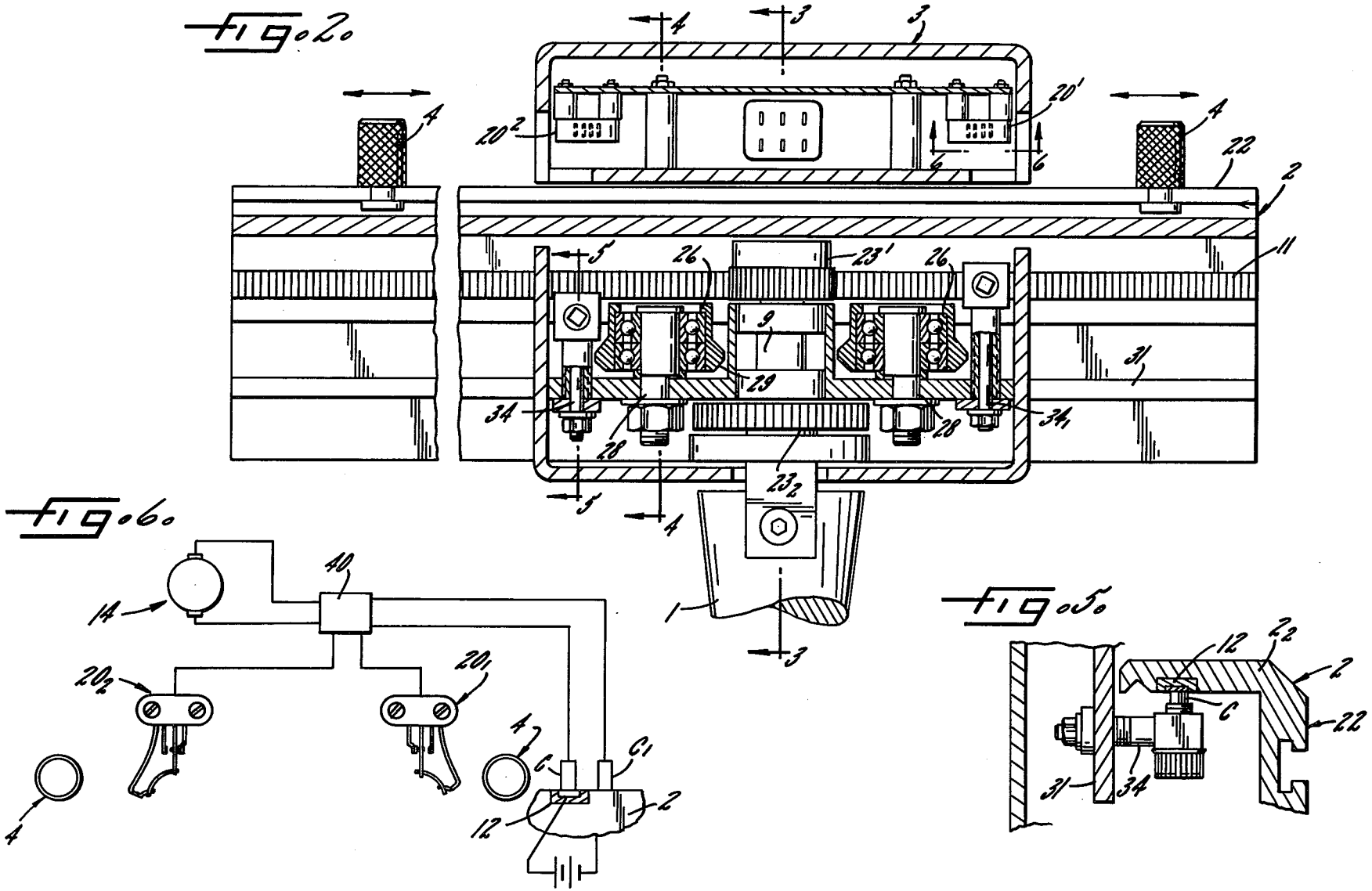
FIG. 2 is a fragmentary sectional view taken on the plane of lines 2—2 of FIG. 1, but with the housing and the agitator control means removed.
FIG. 5 is an enlarged fragmentary sectional view illustrating the means for providing electrical power to the housing.
FIG. 6 is an enlarged fragmentary sectional view of one of the micro switches, taken in the plane of lines 6—6 of FIG. 2.

Referring to FIG. 2, for limiting the linear travel of the mobile assembly including the agitator 1, spaced microswitches $20^1$ and $20^2$ are mounted on the housing 3, which abut against adjustable limit or stop means 4 to limit the linear excursion of the assembly. These stop means 4 are mounted in a longitudinal recess 21 provided in the front face 22 of the guide track or beam 2 and are easily slidable along that member. Sliding them in one direction or the other (indicated by arrow F in FIG. 2) makes it possible to define that section of the ink fountain within which the agitator operates. This makes it possible to use a single guide track 2 for several different agitators, each working in a separate compartment formed by subdividing the ink fountain in order to use different inks, or in order to reduce the ink fountain size. The micro switches $20_1$, $20_2$ are electrically connected to the drive motor 14 by means of a circuit which reverses the direction of rotation of the motor 14 as the micro switches are alternately operated upon engagement by the limit or stop means 4.

Figure 4:
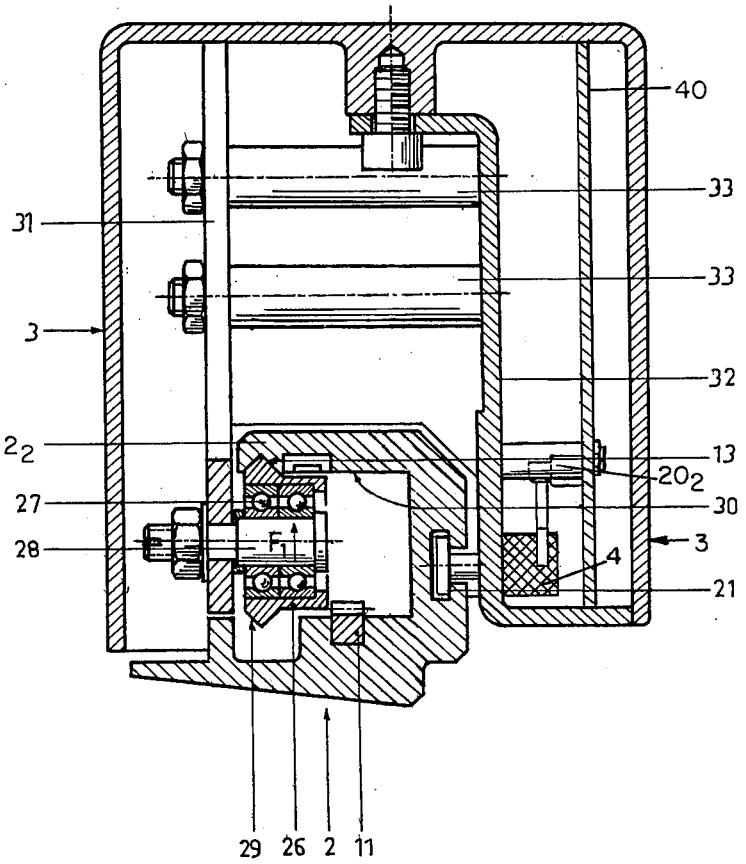
FIG. 4 is a view in section taken in the plane of lines 4—4 of FIG. 2.

Displacement and linear guidance of the assembly including the agitator 1 along the guide track 2 is facilitated by plastic rollers $23_1$ and $23_2$ bearing on this lower arm $2_1$ of the guide track or beam 2. These rollers, which may be nylon, move on flat shoulders 24 and 25 provided on the inner wall of this arm. This constitutes the lower track for the mobile assembly. The upper track is provided (FIG. 4) by the inner wall of the other arm $2_2$ of the guide track or beam 2 in which there is formed an elongated V-groove 13 receiving casters 26 mounted by roller bearings 27 on eccentric shafts 28. These casters are free-wheeling and are annular in form with a V-shaped periphery 29 mating with the groove 13. These casters are mounted on eccentric shafts so that they may be adjusted in vertical position as indicated by the arrow $F_1$ in FIG. 4, and the lock nuts on the ends of the shafts 38 tightened to fix the shafts in their adjusted positions with the casters 26 held in smooth rolling contact with the upper arm of the track or beam 2 with the rollers $23_1$ and $23_2$ bearing against the lower arm 2, thereof.

These casters 26 (FIG. 2) are located on opposite sides of the shaft 9 of the agitator 1 in a fore and aft direction, and in a common oblique plane between the rollers $23_1$, $23_2$ to stabilize the mobile assembly in its linear movement along the guide track 2. The eccentric shafts 28 of these casters are supported by the main support plate 31, attached to an internal wall 32 of the housing 3 by mounting members 33. Plate 31 also supports the two contact-bearing shafts, one of which (34) carries the contact C which is in contact with energized bus 12 (FIG. 3), while the other ($34_1$) carries a contact $C_1$ which engages a flat portion of the guide track or beam 2 which serves as ground.

To supply electrical power to the mobile assembly including the housing 3 and agitator 1, as shown schematically in FIG. 6, a separate D.C. source is utilized to energize the electric bus 12. The contact C on the end of the shaft 34 serves as means to conduct D.C. current to the armature windings of the motor 14 from the bus 12 via wiring connections and motor control means included on the circuit board 40, the circuit being completed by the shaft $34_1$ and contact $C_1$ slidably engaging the track 2 along a portion separate from the insulated bus 12. The board 40 is also electrically connected to the micro switches $20_1$ and $20_2$. From FIGS. 1 and 2 it can be seen that the housing 3 clears the stop means 4 on the upper back side of the track 2, so that as the mobile assembly approaches one of the stop means 4 depending on the direction of its linear displacement, the respective stop means 4 enters the housing 3 and meets the associated micro switch $20_1$ or $20_2$ to shift its contact elements. The micro switches $20_1$ and $20_2$ are connected in a conventional motor control circuit provided by the board 40 to reverse the polarity of the D.C. current applied to the motor armature windings, or by an equivalent manner, to reverse the direction of rotation of the motor 14 as each of the micro switches $20_1$ or $20_2$ is actuated. In this manner the direction of linear displacement of the mobile assembly is automatically reversed at the limits of linear travel defined by the spaced stop means 4.

Since the motor 14 is connected both to rotate the agitator 1 and to displace the mobile assembly along the track 2, the assembly of the housing 3 including the components therein and the agitator 1, is a self powered unitary assembly which while electrically powered from a separate source operates without any cables but rather takes the requisite power from the bus or electrical rail 12 by means of the sliding electric contact member C. Neither is a chain or belt transmission required, and the assembly is readily removed from the track 2 to be cleaned, serviced or relocated on a different printing machine, or over a different compartment of the ink fountain of the same printing machine, the same means for supplying electrical power being usable for multiple assemblies on the same track in a multi-compartmented ink fountain containing inks of different colors.

Figure 1:
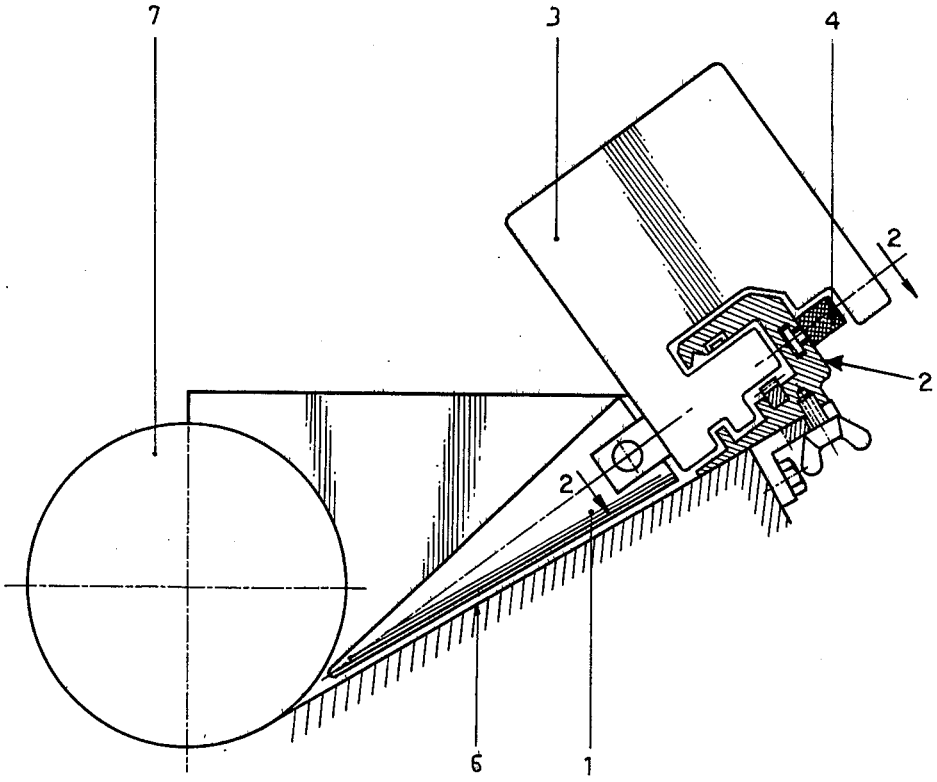
FIG. 1 is a diagrammatic illustration of a power driven agitator mounted on the ink fountain of a printing machine.

The track 2 for supporting the mobile assembly is adapted to be mounted on so as to be parallel to the longitudinal axis of the ink fountain of a printing machine, as shown in FIG. 1, by mounting clamps 42 and may be releasably fastened thereto by means of the wing nuts 43. Thus, the entire track 2 and mobile assemblies associated therewith may be bodily moved from one printing machine to another, to enhance the utility of devices constructed in accordance with the invention.

What is claimed is:

1. In an ink agitating apparatus for ink fountains of printing machines, the combination comprising:

an elongated ink fountain having an inclined blade defining a bottom wall of the ink fountain and an ink roller mounted tangential to the bottom portion of the blade for rotation on a longitudinal axis of said ink fountain;

a replaceable ink agitator device adapted to be removably mounted above said ink fountain;

means providing a support for said replaceable ink agitator device adjacent the top portion of said blade;

said ink agitator device including a self-driven mobile assembly including an ink agitator in the form of a tapered elongated element rotatable about its longitudinal axis and operable to agitate ink in said ink fountain when located adjacent said inclined blade with its tapered tip projecting into a crevice formed between said roller and said bottom wall of the ink fountain;

said ink agitator device further including a beam, means for removably fastening said beam on said support means with said beam extending parallel to said longitudinal axis of said ink fountain, said beam including means providing a guide track for supporting said mobile assembly for linear displacement along said ink fountain with said ink agitator element projecting into said ink fountain and located adjacent said inclined blade, said beam having a U-shaped cross section with a pair of parallel arms, said arms extending substantially parallel to said inclined blade and the open side of said beam between said arms facing said ink fountain, said beam having a rack extending lengthwise of said beam on the inside of one of said arms;

said mobile assembly including a reversible motor, drive means connecting said motor to rotate said agitator element including an agitator shaft supporting said agitator element and extending parallel to said arms through said open side and between said arms into the hollow of said beam, means in rolling engagement with both said arms for supporting said mobile assembly for linear displacement along said beam, said assembly supporting means including a pair of spaced rollers carried by said agitator shaft in rolling engagement with one of said arms and a pair of casters carried one on each side of said agitator shaft in a fore-and-aft direction in rolling engagement with the other of said arms, said casters having an axis of rotation parallel to said agitator shaft which is adjustable in a direction normal to said arms, adjustment of the axis of rotation of said casters providing means for adjusting said casters and rollers into smooth rolling contact with both said arms, a pinion fixed for rotation with said agitator shaft meshing with said rack on said guide track, and drive means connecting said motor to rotate said pinion for both rotating said agitator and linearly displacing said assembly along said track.

2. In an ink agitating apparatus for ink fountains of printing machines, the combination comprising:

an elongated ink fountain having an inclined blade defining a bottom wall of the ink fountain and an ink roller mounted tangential to the bottom portion of the blade for rotation on a longitudinal axis of said ink fountain, and a unitary ink agitator device comprising a beam providing a guide track, and a mobile assembly supported on said guide track for linear displacement along said ink fountain with said ink agitator element projecting into said ink fountain, said beam and mobile assembly providing a unitary device adapted to be removably mounted above said ink fountain, means providing a support for said ink agitator device adjacent the top portion of said blade;

means for removably fastening said beam on said support means with said beam extending parallel to said longitudinal axis of said ink fountain;

said beam having a U-shaped cross section with a pair of parallel arms extending substantially parallel to said inclined blade and the open side of said beam between said arms facing said ink fountain, when fastened on said support means, said beam having a rack extending lengthwise of said beam on the inside of one of said arms;

said mobile assembly including a reversible motor, drive means connecting said motor to rotate said agitator element including an agitator shaft supporting said agitator element and extending parallel to said arms through said open side and between said arms into the hollow of said beam, said shaft extending on the longitudinal axis of said agitator element and carrying said element adjacent said inclined blade of said ink fountain with its tip projecting into a crevice formed between said roller and said bottom wall of the ink fountain and operable to agitate ink in said ink fountain when rotated about its longitudinal axis, a pinion fixed for rotation with said agitator shaft meshing with said rack on said guide track, and drive means connecting said motor to rotate said pinion for both rotating said agitator and linearly displacing said assembly along said track.

3. In an ink agitating apparatus for ink fountains of printing machines according to claim 2, said mobile assembly supporting means further including a pair of spaced rollers carried by said agitator shaft in rolling engagement with one of said arms and a pair of casters carried one on each side of said agitator shaft in a fore-and-aft direction in rolling engagement with the other of said arms, said casters having an axis of rotation parallel to said agitator shaft which is adjustable in a direction normal to said arms, adjustment of the axis of rotation of said casters providing means for adjusting said casters and rollers into smooth rolling contact with both of said arms.

4. In an ink agitating device, the combination according to claim 2, said beam having an exposed bus electrically insulated from said beam, and said mobile assembly having a pair of contact members respectively mounted for contact with said bus and said beam separate from said bus upon linear displacement of said assembly along said beam, said beam having spaced stop means adjustably mounted thereon and defining the limits of linear displacement of said assembly along said beam, said assembly having electrical means mounted thereon for movement alternately into engagement with said stop means upon linear displacement of said assembly in one direction or the other along said beam, said assembly further including control circuit means electrically connecting said motor, said electrical means for engaging said stop means and said contact members.

* * * * *